US011906161B2

(12) United States Patent
Zeng

(10) Patent No.: US 11,906,161 B2
(45) Date of Patent: Feb. 20, 2024

(54) APPARATUS FOR MONITORING LEVEL OF ASSIST GAS TO INDUSTRIAL FLARE

(71) Applicant: Yousheng Zeng, Baton Rouge, LA (US)

(72) Inventor: Yousheng Zeng, Baton Rouge, LA (US)

( * ) Notice: Subject to any disclaimer, the term of this patent is extended or adjusted under 35 U.S.C. 154(b) by 156 days.

(21) Appl. No.: 17/336,077

(22) Filed: Jun. 1, 2021

(65) Prior Publication Data

US 2021/0372613 A1 Dec. 2, 2021

Related U.S. Application Data

(60) Provisional application No. 63/048,953, filed on Jul. 7, 2020, provisional application No. 63/032,931, filed on Jun. 1, 2020.

(51) Int. Cl.
*F23G 5/50* (2006.01)
*F23G 7/08* (2006.01)

(52) U.S. Cl.
CPC ..... *F23G 5/50* (2013.01); *F23G 7/085* (2013.01); *F23G 2207/101* (2013.01); *F23G 2207/30* (2013.01); *F23G 2209/14* (2013.01); *F23N 2229/04* (2020.01)

(58) Field of Classification Search
CPC . F23G 5/50; F23G 7/085; F23N 5/082; F23N 2229/04; F23N 2229/20; F23N 2229/16; F23N 2229/00; F23N 2225/10; F23N 2225/08; F23N 2241/11; F23N 2241/12; F23N 2241/16; G01J 5/0014; G01J 5/0018; G01J 5/602; G01J 2005/604; G01J 5/0801; G01J 5/0802; G01J 2005/607
See application file for complete search history.

(56) References Cited

U.S. PATENT DOCUMENTS 4,233,596 A * 11/1980 Okamoto ..... F23N 5/082 431/14
4,435,149 A * 3/1984 Astheimer ..... F23N 1/022 431/12
4,866,420 A * 9/1989 Meyer, Jr. ..... G08B 17/12 250/340

(Continued)

*Primary Examiner* — Vivek K Shirsat
(74) *Attorney, Agent, or Firm* — Stuart M. Goldstein

(57) ABSTRACT

A remote sensing system which may be assembled with an Infrared (IR) sensor, or a plurality of IR sensors, disposed to sense IR radiance emitted as combustion products from a flare stack in two distinctive spectral bands, each band having a narrow spectral bandpass, the sensor being radiometrically calibrated to sense transmission characteristics of the two distinctive bands of the radiance from flare combustion gases; and an analyzer driven by a microcontroller, coupled to the IR sensor, to operationally respond in real time by generating an indication of flare stack's performance through a parameter derived from a ratio of the transmission characteristics of the two radiance outputs sensed by the IR sensor. The IR sensor of this flare monitoring-apparatus must be positioned in such a way that the anticipated entire flame will be captured within the Field of View (FoV) of the IR sensor, or sensors.

14 Claims, 6 Drawing Sheets
(6 of 6 Drawing Sheet(s) Filed in Color)

(56) References Cited

U.S. PATENT DOCUMENTS

| | | | | |
|---|---|---|---|---|
| 5,360,335 | A * | 11/1994 | Anderson | F23N 1/002 431/31 |
| 6,078,050 | A * | 6/2000 | Castleman | G08B 25/002 250/342 |
| 2002/0158202 | A1* | 10/2002 | Webber | F23N 5/003 431/75 |
| 2013/0342680 | A1* | 12/2013 | Zeng | G01J 5/0806 348/135 |
| 2014/0226694 | A1* | 8/2014 | Kullenberg | G01N 23/087 374/38 |
| 2017/0370579 | A1* | 12/2017 | Johnson | F23G 7/065 |
| 2018/0209853 | A1* | 7/2018 | Kraus | G01J 5/0014 |
| 2019/0242575 | A1* | 8/2019 | Fisher | F23L 7/005 |
| 2021/0372864 | A1* | 12/2021 | Tao | F01N 11/00 |

* cited by examiner

APPARATUS FOR MONITORING LEVEL OF ASSIST GAS TO INDUSTRIAL FLARE

CROSS-REFERENCE TO RELATED APPLICATIONS

This application makes reference to, and incorporates herein, the entirety of a provisional application entitled Apparatus For Monitoring Level Of Assist Gas To Industrial Flare, filed in the United States Patent & Trademark Office on 1 Jun. 2020, and there regularly assigned Ser. No. 63/032,931. This application further makes reference to, and incorporates herein, the entirety of a provisional application entitled Apparatus For Monitoring Level Of Assist Gas To Industrial Flare, filed in the United States Patent & Trademark Office on 7 Jul. 2020, and them regularly assigned Ser. No. 63/048,953.

FIELD OF THE INVENTION

This invention relates to apparatus and methods for monitoring the performance of industrial flare stacks by monitoring the level of assist gas, commonly in the form of air or steam, provided to industrial flare stacks.

BACKGROUND

A gas flare, alternatively known as a flare stack, is a regulated waste gas control apparatus erected at an emission point that basically functions as a gas combustion device incorporated into industrial plants such as petroleum refineries, chemical plants and natural gas processing plants. Flare stacks are also commonly installed at oil or gas extraction sites having oil wells, gas wells, offshore oil and gas rigs and landfills.

In industrial plants, flare stacks are primarily used for burning off flammable gas released by pressure relief valves during unplanned occurrences of over-pressurized units of plant equipment. During plant or partial plant startups and shutdowns, flare stacks are also often used for the planned combustion of gases over relatively short periods.

At oil and gas extraction sites, gas flare stacks are similarly used for a variety of startup, maintenance, testing, safety, and emergency purposes. In a practice known as production flaring, they may also be used to dispose of large amounts of unwanted associated petroleum gas, possibly throughout the life of an oil well.

Flare stacks are commonly used at industrial facilities (e.g., oil and gas extraction and production sites, gas processing plants, oil refineries, and petrochemical manufacturing plants) to safely dispose of process gases (waste gases) which must be vented into the atmosphere due to process upset or the process gases being unrecoverable for technical or economic reasons. The gases sent to flare stacks are typically combustible, and generally contain hydrocarbons and other air pollutants. Environmental and safety regulations prohibit discharge of such waste gases into the atmosphere without having been treated by a flare stack because of the potential for fire hazard and negative effects on human health and the environment.

Flare stacks are designed to destroy the waste gases by combusting the waste gases into harmless or less harmful gases (e.g., hydrocarbons combusted into water vapor and carbon dioxide). When waste gases reach the flare tip, a pilot flame positioned at the flare tip ignites and burns the waste gases with oxygen from ambient air.

SUMMARY OF THE INVENTION

Practice of the principles of the present invention contemplate an Infrared (IR) remote sensing device that is capable of measuring within two spectral bands, the IR radiance emitted from the flare stack's flame obtained by the combustion of gaseous or aerosol fuel transiting the flare stack. The IR sensor monitoring each of the spectral bands is radiometrically calibrated against a blackbody radiance calibration source in order to assure accurate measurement of radiance. The ratio of these two radiances emitted by the flame of the gas flare and detected by the sensor in the two IR spectral bands, forms an index that serves the same purpose as the Net Heating Value within the combustion zone (i.e., NHVcz). The index is hereafter referred to as the Combustion Index (CI). The primary benefit of using CI (rather than NHVcz) is that CI can be determined with the use of a single instrument that operates independently from the process streams leading into the flare stack. In the practice of the present invention, apparatus can be set up at a distance from the flare stack, to remotely and continuously monitor performance of the flare stack, and to provide feedback to either the operator of the flare stack or to a closed loop flare control system to assure optimal operation of the flare stack. In alternative practice of this invention, a single apparatus can be placed on a pan/tilt device to monitor multiple flares.

A properly formulated CI variable may be highly correlated to NHVcz and, when properly calibrated, may be used as an alternate technique to measure NHVcz (i.e., alternate to the conventional method specified by the EPA regulations). With this calibration, the same remote sensing device for CI may be used to directly monitor NHVcz of the flare stack, thereby eliminating a need to install multiple instruments on process lines which would be otherwise necessary to derive NHVcz under the conventional method.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings. The patent or application file contains at least one drawing executed in color. Copies of this patent or patent application publication with color drawing(s) will be provided by the Office upon request and payment of the necessary fee.

DETAILED DESCRIPTION

Figure 3:
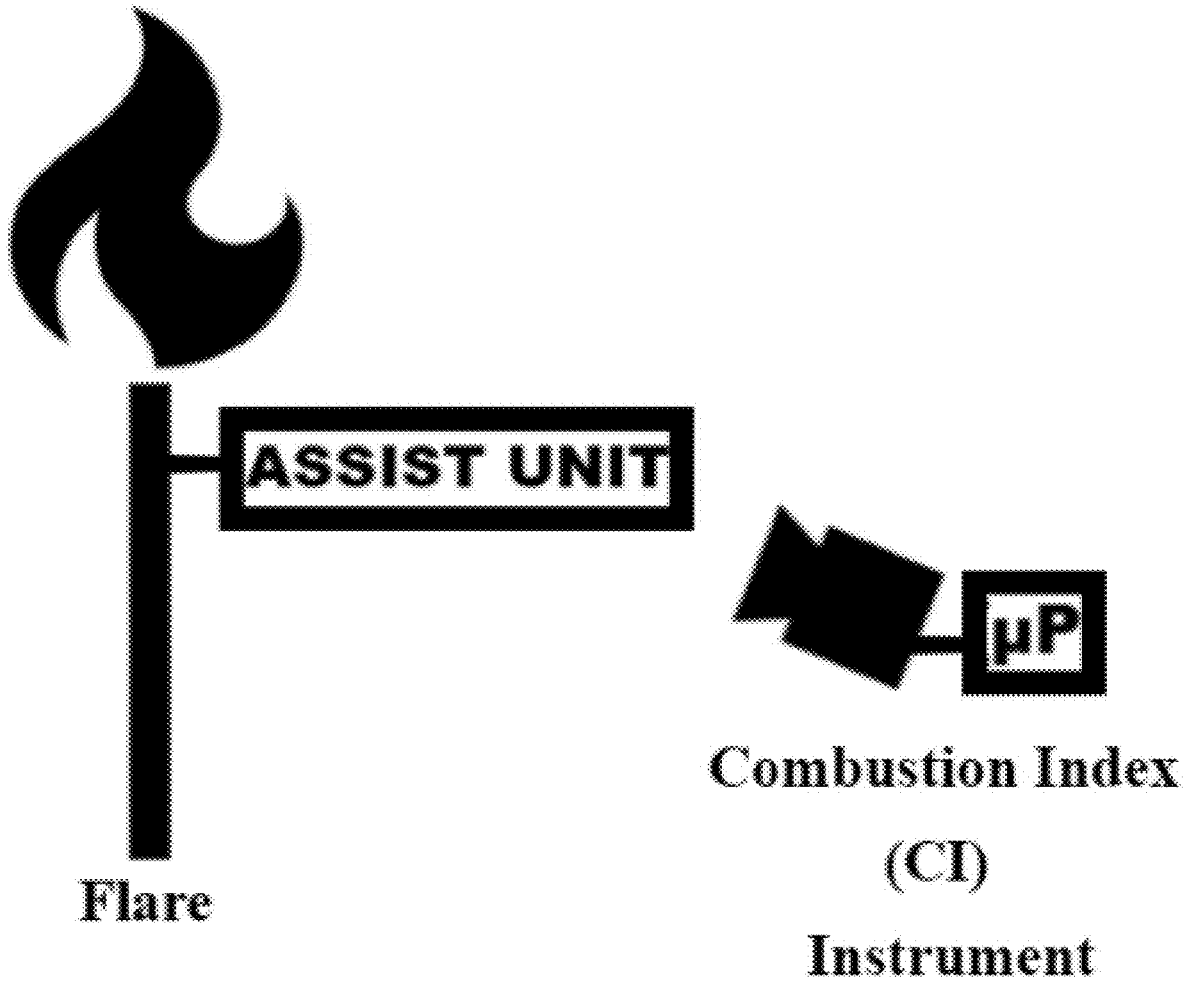
FIG. 3 shows a setup for a flare monitoring system using the CI instrument.

Referring briefly to FIG. 3, many modern flare stacks are equipped with steam or air assist systems. The purpose of providing steam or air assistance near the distal end of the flare stack's tip is to promote good combustion of the waste gas by increasing the mixing of ambient air with fuel in the combustion zone. An insufficient volume of ambient air can result in incomplete combustion and black smoke. When the flare is over-assisted (i.e., when too great a volume of steam assist or air assist is provided to the flare stack), the combustion zone temperature may be lowered, and the combustion may not be complete. During the past decade, the issue of over-assistance has been a point of focus for environmental regulatory agencies, industries, and the public. In recent years, the U.S. Environmental Protection Agency (EPA) has promulgated new regulations that require flare operators to continuously monitor the flare gas net heating value (NHV) and the amount of steam or air assist provided in order to derive a compliance parameter called combustion zone net heating value (CZNHV, which is also denoted as NHVcz, in the regulation and other publications). The new regulations require operators of steam-assisted flare stacks to maintain the value of NHVcz above 270 British Thermal Units per standard cubic feet (BTU/scf) to be considered to be in compliance.

Figure 1:
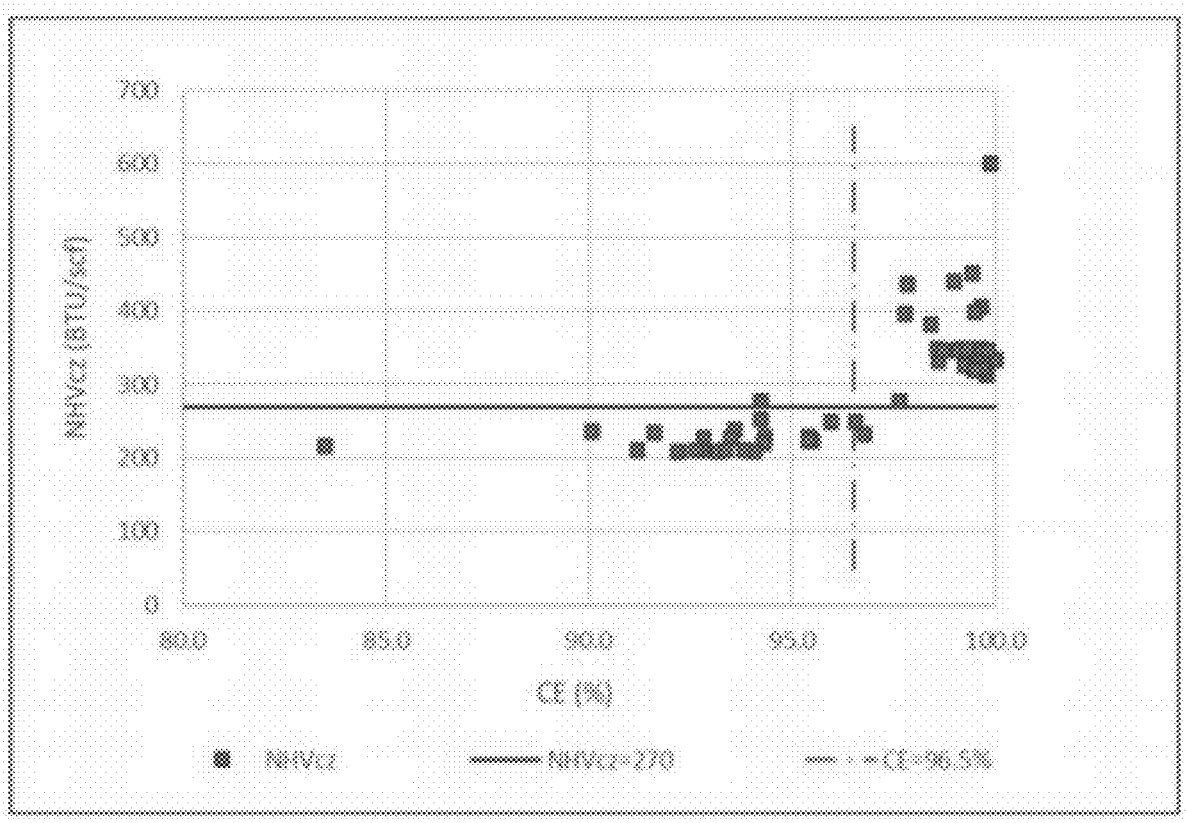
FIG. 1 is a graph prepared with two orthogonal axis cartesian coordinates that illustrate the relationship between the CE and NHVcz, and the regulatory objective of CE≥96.5%.

The basis for the regulatory threshold of NHVcz=270 BTU/scf is an empirical study which found that a NHVcz above 270 BTU/scf results in a combustion efficiency (CE) of 96.5% or higher, which satisfies the regulatory objective of destroying the waste gases. The relationship between the CE and NHVcz is illustrated in FIG. 1 along with the regulatory objective of CE≥96.5% (represented by the vertical dashed and dotted line in FIG. 1) and the regulatory threshold of NHVcz≥270 BTU/scf (represented by the horizontal unbroken line in FIG. 1). When NHVcz is below 270 BTU/scf, a facility must either reduce the volume of assist gas or add supplemental fuel to the waste gas stream in order to increase NHVcz.

The data necessary to derive the regulatory compliance parameter, NHVcz, include 1) flare vent gas composition or net healing value, vent gas flow rate, temperature, and pressure; 2) flow rate, temperature, and pressure of the assist gas; and 3) flow rate, temperature, and pressure of supplemental fuel. This amounts to a total of ten instruments and sensors installed on the vent gas line, the assist gas line, and the supplemental fuel line for each flare stack. The capital and operating costs of such a flare stack NHVcz monitoring system is very high. The reason for this complicated monitoring system is that there is no practical and satisfactory method or apparatus to directly measure the NHVcz at the flare stack's tip.

Principles of the present invention will now be described more completely with reference to the accompanying drawings, in which exemplary embodiments for the practice of those principles are shown.

Embodiments of the principles of the present invention contemplate as an essential apparatus, an IR sensor that meets the following three minimum requirements: 1) it should have two distinctive IR spectral bands, with each band having a relatively narrow bandpass; 2) the measurement of the radiances in the two spectral bands must be temporarily synchronized so that the two measurements represent the same flare condition, which can change rapidly; and 3) the two IR spectral bands must be radiometrically calibrated, meaning that the output from each spectral band is a) an apparent temperature that is consistent with the temperature of a blackbody used to calibrate the sensor or b) radiance that is consistent with the radiance emitted in their respective wavelengths of the two spectral bands by a blackbody used to calibrate the sensor. The radiometric calibration can be accomplished by using the same procedures used to calibrate thermography IR sensors, provided that the temperature range of the blackbody is similar to the apparent temperature expected in a flare stack's flame (e.g., 300-1200 degree C.). The apparent temperature readings and the IR radiance values (e.g., expressed in the units of $W \cdot sr^{-1} \cdot m^{-2} \cdot \mu^{-1}$ or $W \cdot sr^{-1} \cdot m^{-2}$) are considered interchangeable using the Planck Equation. The sensor can be calibrated for either unit. However, the ratio to be used for CI is based on the radiance bands of the combustion emanating from the flare stack. The ratio of these two radiances emitted by the flare stack's flames and detected by the sensor in each of the two IR spectral bands, forms an index that serves the same purpose as the NHVcz measurement. The index is hereafter referred to as the Combustion Index (CI).

Figure 2:
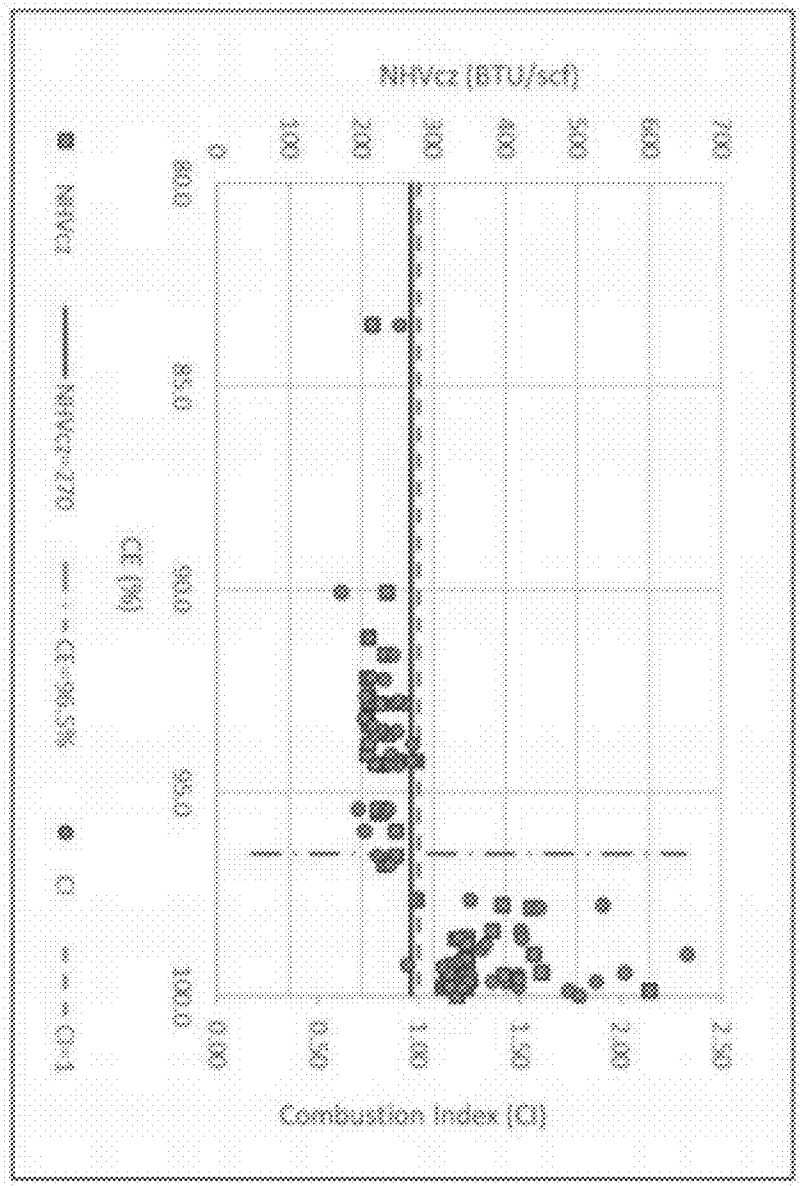
FIG. 2 is a graph prepared with two axis orthogonal cartesian coordinates that illustrate the equivalency of CI to NHVcz in a method to monitor flare performance and ensure that waste gases are burned completely.

FIG. 2 illustrates the equivalency of CI to NHVcz in a technique to monitor the flare stack's performance and thereby ensure that waste gases are being burned completely. The primary benefit of using CI (rather than NHVcz) is that CI can be determined with the use of a single instrument that operates independently from the process streams leading into the flare stack.

The CI is a unitless parameter and is calculated by the following Equation (1):

$$CI = c\frac{R1}{R2} \qquad \text{Eq. (1)}$$

where R1 and R2 are the radiances measured in spectral band 1 and band 2, respectively, and where c is a calibration coefficient.

FIG. 3 illustrates that in the practice of the principles of this invention, the CI apparatus may be set up at a distance from the flare stack, in such a way that the flame of the flare stack will be captured within the Field of View of the CI apparatus. The CI apparatus is equipped with a microcontroller μP, and is coupled to the IR sensor or sensors, in order to operationally respond in real time, by generating an indication of flare performance through a parameter i.e., Combustion Index, derived from the ratio of the two radiance outputs by the IR sensor, or sensors, in order to remotely and continuously monitor flare performance, and provide feedback to either the operator or the owner of the flare stack, or to a closed loop flare control system to enable optimal operation of the flame. In another embodiment of this invention, a single apparatus may be placed on a pan/tilt device to monitor multiple flare stacks.

Figure 4:
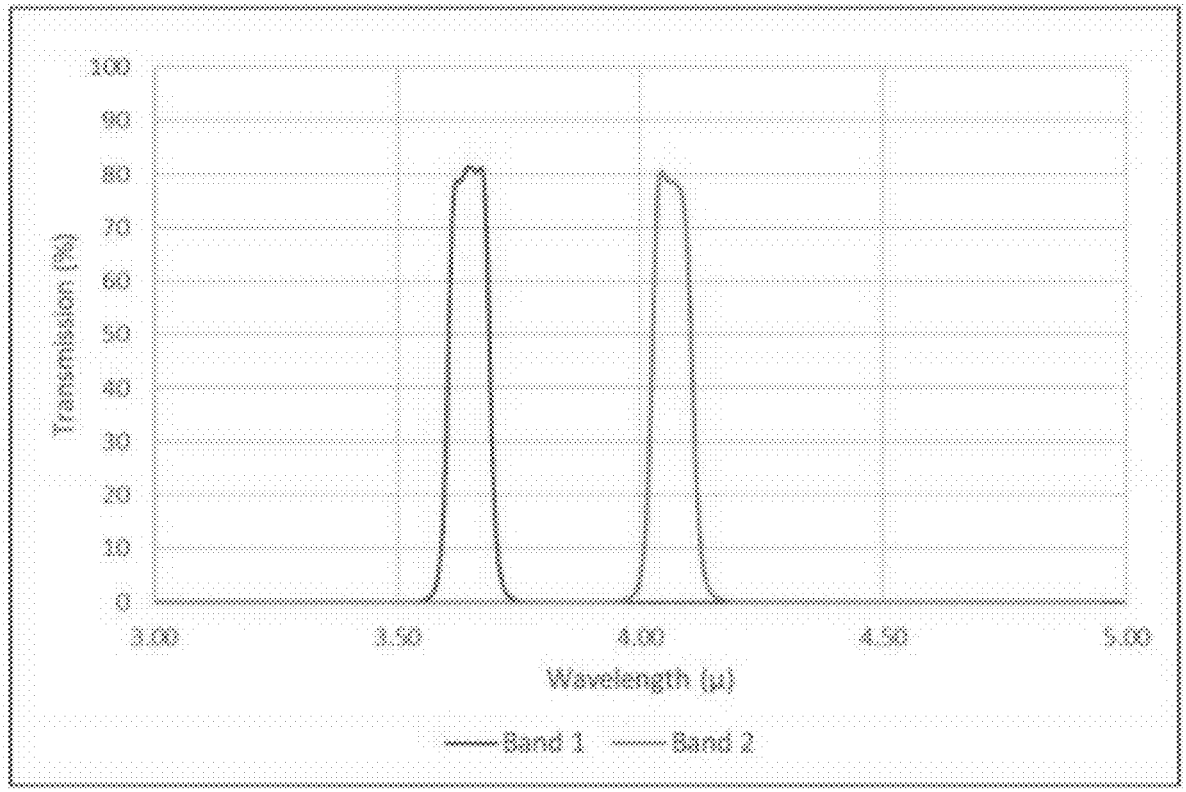
FIG. 4 illustrates one embodiment of transmission curves for the two bandpass filters that are used to selectively allow IR radiance into the IR sensors for two distinctive IR spectral bands.
Figure 5:
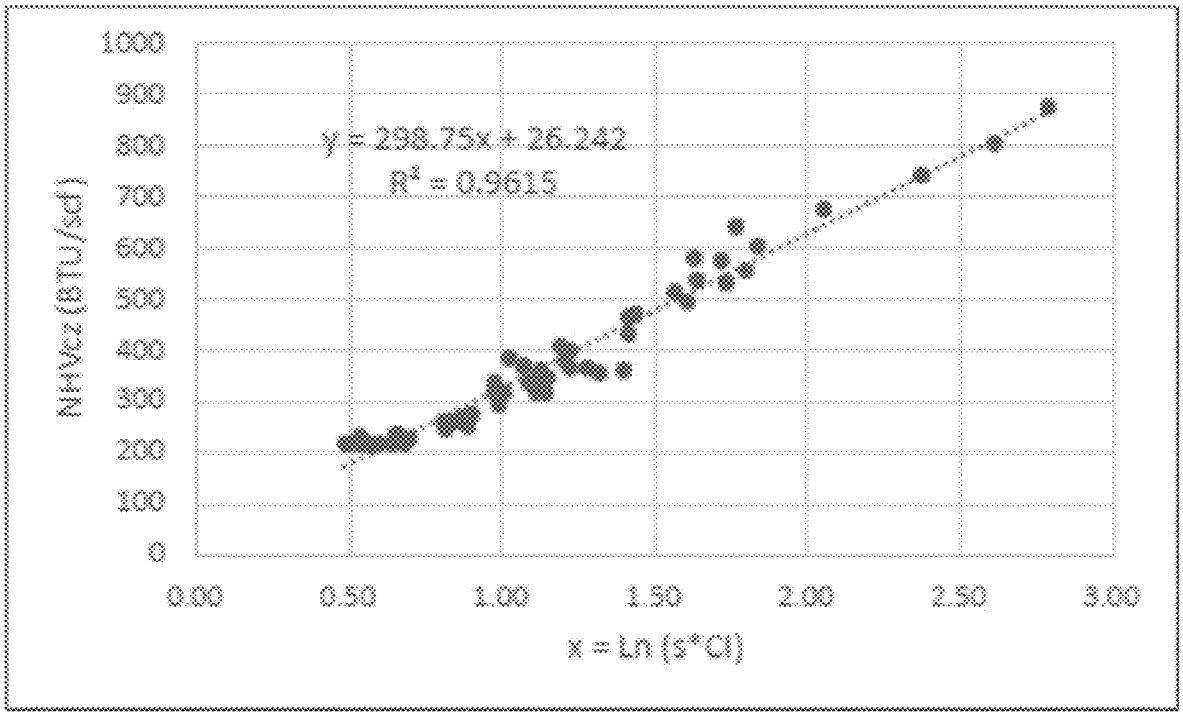
FIG. 5 is a two-coordinate cartesian coordinate graph illustrating an exemplary calibration curve for a NHVcz measurement to show correlation between CI and NHVcz.
Figure 6:
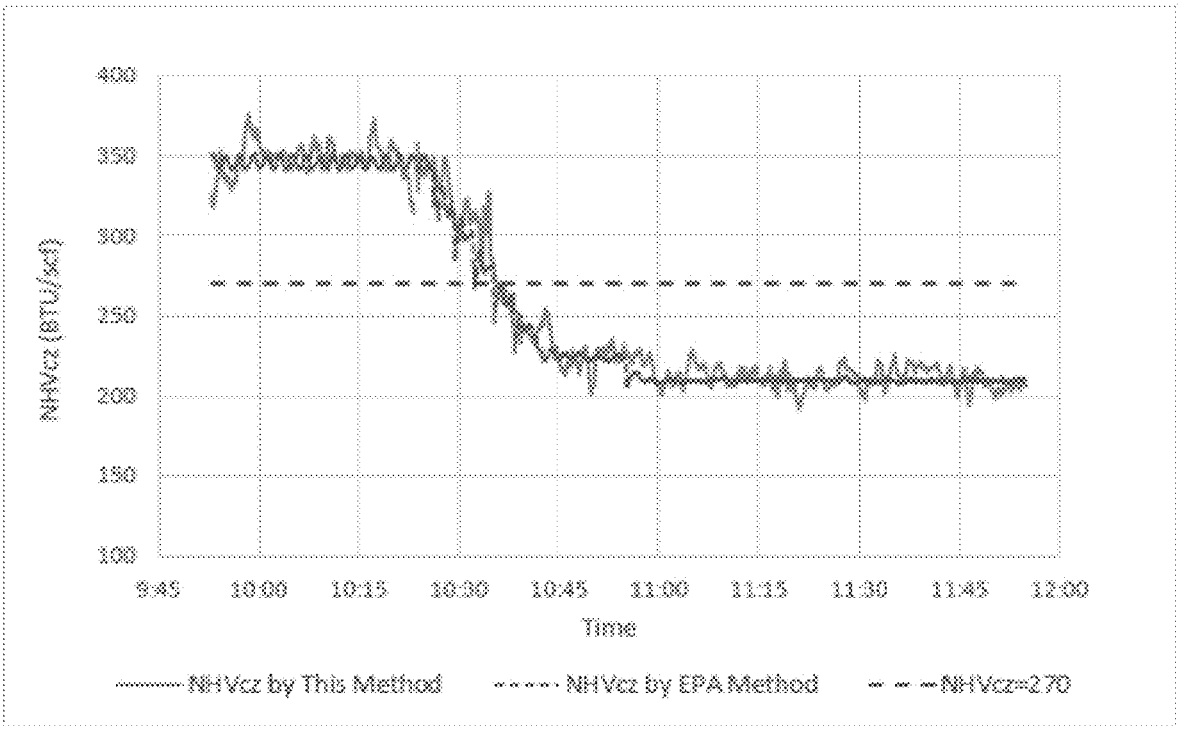
FIG. 6 is a two-coordinate cartesian graph showing a comparison between NHVcz measured by the conventional method sometimes referred to as the EPA reference method, and NHVcz as practiced according to the principles described in the following paragraphs.

FIG. 4 illustrates an embodiment of bandpass filters for the two spectral bands. In this embodiment, the two spectral bands are in the mid-wave IR region with IR wavelengths between 3-5 micrometers (μm). Spectral band 1 has a shorter wavelength than the wavelength of spectral band 2. The extent of separation between the two spectral bands will control the value of CI independent of the performance of the flare stack. The extent of separation should be sufficiently large without entering the IR region where water molecules or carbon dioxide molecules in the atmosphere may interfere with the radiance measurement. On the other hand, when the two spectral bands are too close to each other, the ratio of the two radiances will be closer to 1 and the CI value will be less responsive to the NHVcz change and the performance of the flare stack. The value c is used to standardize the CI so that the CI values derived from different designs for the bandpass filters can be made comparable and the same CI threshold value for good combustion can be established for different design in spectral bands. The value c needs to be established through a calibration process.

During the calibration, a flare stack will be operated with instruments to measure NHVcz in conformance with the method established by EPA flare stack regulation (see 40 CFR § 63.670).

Combustion efficiency (CE) of the flare stack may be measured by either an extractive sampling method or another validated method. The flare stack will be operated in a sufficiently wide range of NHVcz and CE to construct a chart similar to the graph presented by FIG. 1. At the same time, the radiometrically calibrated two-band IR sensor will be used to measure the values of R1 and R2, and the CI will be derived with an assumed calibration coefficient c. The CI value derived will be added to the NHVcz-CE chart in order to form a chart similar to the chart shown in FIG. 2. The value of the calibration coefficient c for this particular design of an IR sensor deployment will be determined by trial-and-error so that the data points for CI-CE will match the pattern of the data points for NHVcz-CE as shown in FIG. 2, i.e., the data points will be scattered only in the upper right quadrant and lower left quadrant divided by the vertical line of CE=96.5%, and the first horizontal line of NHVcz=270 BTU/scf for the NHVcz-CE data points and the second horizontal line of the CI at CI=1 for the CI-CE data points. In both FIG. 4 and in Equation 1, Band 1 is defined as at a lower band than Band 2. The extent of separation controls the value of CI independently of the flame emitted by the flare stack. The extent of separation will affect the value of CI under the same flare condition. The constant c is used to account for the differences caused by designs of the two bandpass filters. If the center wavelengths of the two spectral bands are too close together, the ratio will be closer to 1 and the index could be either insensitive or unresponsive to the NHVcz. If the center wavelengths are too far apart, one or both of the indices will be subject to interference from ambient water molecules or carbon dioxide molecules in the atmosphere.

Once Eq. (1) is established (i.e., the value of term c is determined) for a specific design of the two-band IR sensor, the sensor is ready for monitoring flare performance. The CI will be continuously calculated using Eq. (1) and the radiance measurements of R1 and R2 by the IR sensor. If the CI is greater than 1, it indicates that the NHVcz is greater than the regulatory threshold of 270 BTU/scf and that the flare is in good combustion condition (CE≥96.5%). If the CI is less than 1, it indicates that the NHVcz is below the regulatory threshold of 270 BTU/scf and that the flare does not meet the required combustion efficiency. If possible, the flare operator should adjust the operating conditions and bring the CI to a level greater than 1. CI is an index, consequently the threshold for CI does not have to be 1. In point of fact, CI may have another value so long as the threshold value serves the purpose of dividing the CI results into the two quadrants in the same way as NHVcz does (i.e., with a separation between CI similar to the pattern shown in FIG. 2) in order that the CI can be used to determine acceptable or unacceptable combustion within a reasonable margin of error.

Provided that the IR sensor meets the three minimum requirements described earlier in this section, the specifications for the IR sensor are flexible. In one embodiment of the invention, the two spectral bands may be accomplished by using two separate IR sensors, each equipped with a bandpass filter.

In another embodiment of the invention, the two spectral bands are accomplished with a single IR sensor equipped with a filter wheel to alternately position different bandpass filters in front of the JR sensor. In this case, the rotation of the filter wheel must be sufficiently high so that the time gap between the filter for R1 measurement and filter for R2 measurement is negligible comparing to the rate of change in the IR radiance emitted by the flare stack's flame.

In another embodiment of the principles of the invention, the two spectral bands are accomplished with a single IR sensor using a diffractive optical path.

In another embodiment of the principles of the invention, the two spectral bands are attained by using a single IR sensor with a micro lens array and micro filter array.

In another embodiment of the principles of the invention, the two spectral bands may be accomplished by using a single dual-color IR sensor with spectral responses within two different regions.

The IR sensor's pixel resolution will affect the applicability of the apparatus. A sensor array with a high pixel resolution will allow the apparatus to be deployed at a longer distance from the flare. In order to obtain an accurate measurement of radiance values R1 and R2 in Eq. (1), the theoretical limit requires that the flame emitted by the flare stack completely fill at least one pixel in the sensor. The more pixels occupied by the flare emitted by the flame stack, the more accurate the R1 and R2 measurements will be. Therefore, a sensor with high pixel resolution can perform this measurement at a longer distance of separation from the flare stack.

In an alternative embodiment, an assist unit may be disposed to inject fluid into the flare stack and promote combustion of fuel transiting the flare stack by inducing mixing of the fuel with the fluid; the injected fluid may be a colloidal suspension of particles dispersed in air or gas.

The foregoing paragraphs contemplate a remote sensing system which may be assembled with an Infrared (IR) sensor, or a plurality of IR sensors, disposed to sense IR radiance emitted as combustion products from a flare stack in two distinctive spectral bands, each band having a narrow spectral bandpass, the sensor being radiometrically calibrated to sense transmission characteristics of the two distinctive bands of the radiance; and an analyzer driven by a microcontroller, coupled to the IR sensor, to operationally respond in real time by generating an indication of flare stack's performance through a parameter derived from a ratio of the transmission characteristics of the two radiance outputs sensed by the IR sensor. The CI monitoring apparatus should be positioned and oriented in such a way that the anticipated entire flame will be captured within the Field of View (FoV) of the IR sensor, or sensors.

What is claimed is:

1. A process of remotely sensing combustion zone net heating values (NHVcz) of industrial flares in order to monitor the flare NHVcz, and thereby allow for the maintenance, in real time, of the regulatory NHVcz threshold of 270 BTU/scf, said process comprising the steps of:

sensing IR radiance emitted in a plurality of distinctive spectral bands by combustion products in gaseous phases or aerosols from within the combustion zone of a flare stack;

in real time, generating combustion zone net heating values for the flare by continually calculating, as a combustion index, the ratio of the radiance of the distinctive spectral bands;

in real time, calculating the NHVcz in accordance with EPA flare stack regulations;

correlating the combustion index and the NHVcz to determine flare performance; and continually allowing for the adjustment of assist media to the flare in order to maintain the flare performance at or above the NHVcz threshold of 270 BTU/scf.

2. The process of claim 1, further comprised of obtaining the IR radiance by orienting an IR sensor toward a flare tip positioned at a distal end of the flare stack and by positioning the IR sensor at a distance that allows the sensor to capture the IR radiance from the entire flare.

3. The process of claim 1, further comprised of disposing a plurality of the Infrared sensors each to sense the IR radiance of a distinctive spectral band, each of the IR sensors being calibrated to accurately measure the IR radiance against a blackbody calibration device.

4. The process of claim 1, further comprised of analyzing in real time, a ratio of the radiances in the distinctive spectral bands which, when calibrated against the combustion zone net heating values measured by a reference method, can be used independently to monitor flare combustion zone net heating value in the flame of the flare stack.

5. A remote sensing system for remotely sensing combustion zone net heating values of industrial flares in order to monitor the flare NHVcz and thereby allow for the maintenance, in real time, of the regulatory NHVcz threshold of 270 BTU/scf, said system comprising:

an Infrared (IR) sensor disposed to sense IR radiance exhibiting two distinctive spectral bands emitted by combustion products in the form of gaseous or aerosols, each band having a spectral bandpass, the sensor being radiometrically calibrated against a blackbody calibration device to sense the radiance characteristics of the two distinctive IR spectral bands;

a flare gas net heating value instrument to measure NHVcz; and an analyzer comprised of a microcontroller coupled to the IR sensor to operationally respond in real time by generating an indication of flare stack's performance as a combustion index derived from a ratio of the transmission characteristics of the two radiance outputs sensed by the IR sensor, wherein the NHVcz is measured in real time by the flare gas net heating value instrument, the combustion index is continuously calculated in real time, and said combustion index is correlated with the NHVcz to determine flare performance and continually allow for the adjustment of the NHVcz to maintain the flare performance at or above the NHVcz EPA regulatory threshold of 270 BTU/scf.

6. The remote sensing system of claim 5, further comprised of the IR sensor being oriented toward a flare tip positioned at a distal end of the flare stack.

7. The remote sensing system of claim 5, further comprised of an assist unit disposed to inject fluid into the flare stack and promote combustion of fuel transiting to the flare stack by inducing more air into the combustion zone of the flame.

8. The remote sensing system of claim 5, further comprised of the microcontroller adjusting a volume of fluid introduced into the flare stack and promoting combustion of fuel transiting to the flare stack by increasing mixing of air with the fuel in the combustion zone of the flame.

9. The remote sensing system of claim 5, further comprised of the microcontroller adjusting a volume of fluid introduced into the flare stack in response upon a combustion zone net heating value derived from a ratio of the transmission characteristics of the two radiance outputs sensed by the IR sensor and calibrated against the combustion zone net heating value measured by a reference method.

10. The remote sensing system of claim 5, further comprised of a plurality of the Infrared sensors each disposed to sense the IR radiance of a distinctive band, each of the IR sensors being calibrated against a blackbody calibration device to measure the IR radiance in a distinct IR spectral band.

11. The remote sensing system of claim 5, further comprised of the IR sensor having a filter wheel set with each filter wheel calibrated to a different one of the spectral bands.

12. The remote sensing system of claim 5, further comprised of the IR sensor providing a diffractive optical path calibrated to pass corresponding one of the distinct spectral bands.

13. The remote sensing system of claim 5, further comprised of the IR sensor having a micro-lens array and a micro-filter array corresponding to respective ones of the spectral bands.

14. The remote sensing system of claim 5, further comprised of the IR sensor exhibiting spectral responses in two different regions, each corresponding to one of the two distinctive spectral bands.

* * * * *